US009373898B1

(12) United States Patent
Sovel et al.

(10) Patent No.: US 9,373,898 B1
(45) Date of Patent: Jun. 21, 2016

(54) SWAGED-ON, EXTERNAL ELECTRODE ANCHORING CONNECTION

(71) Applicants: James E. Sovel, Panama City Beach, FL (US); Jacob Cornman, Panama City Beach, FL (US)

(72) Inventors: James E. Sovel, Panama City Beach, FL (US); Jacob Cornman, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 545 days.

(21) Appl. No.: 13/862,602

(22) Filed: Apr. 15, 2013

(51) Int. Cl.
*H01R 4/62* (2006.01)
*H01R 4/20* (2006.01)
*H01R 43/048* (2006.01)

(52) U.S. Cl.
CPC ..... *H01R 4/203* (2013.01); *H01R 43/048* (2013.01)

(58) Field of Classification Search
CPC ..... H01R 4/203; H01R 4/62; H01R 43/048
USPC ..... 174/84 C
See application file for complete search history.

(56) References Cited

U.S. PATENT DOCUMENTS 1,909,344 A * 5/1933 Green ..... F16G 11/02 191/44.1
4,035,007 A * 7/1977 Harrison ..... F16L 13/004 285/381.2
7,311,553 B2 * 12/2007 Tamm ..... H01R 4/20 439/584

* cited by examiner

*Primary Examiner* — Timothy Thompson
*Assistant Examiner* — Paul McGee, III
(74) *Attorney, Agent, or Firm* — James T. Shepherd

(57) ABSTRACT

A swaged-on fitting, for anchoring exterior wires to a cable, includes an outer ring and a split inner ring. The inner ring has an inside grooved pattern, which is substantially an angled cross-hatching of shallow grooves. The two grooved halves of the inner ring are placed under the bare ends of the wires and pressed on either side of the cable jacket such that the pattern contacts the jacket. The outer ring is slid over the wires, so it overlaps the inner halves. The fitting is swaged-on, locking in the wires between the rings and embossing the jacket with the cross-hatching pattern of the inner ring, without puncturing the jacket. The grooves on the inner ring thus grip the cable jacket, preventing rotational and translational movement of the wires on the jacket while maintaining the structural integrity of the jacket.

15 Claims, 7 Drawing Sheets

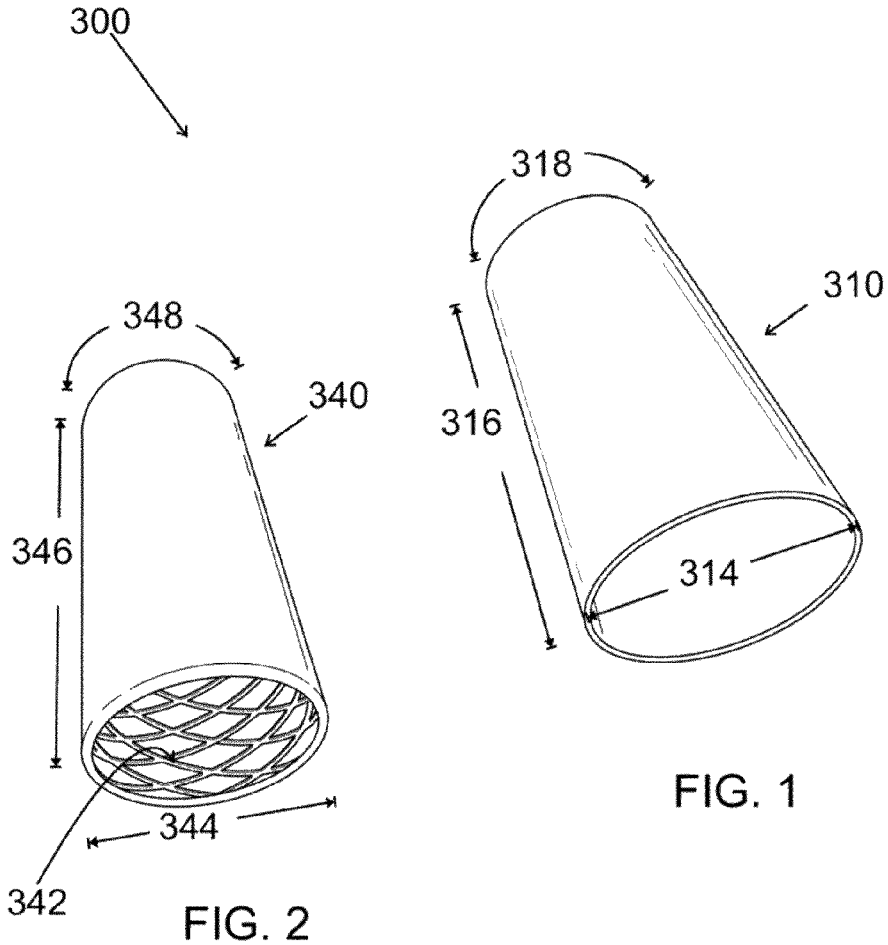
FIG. 1
FIG. 2
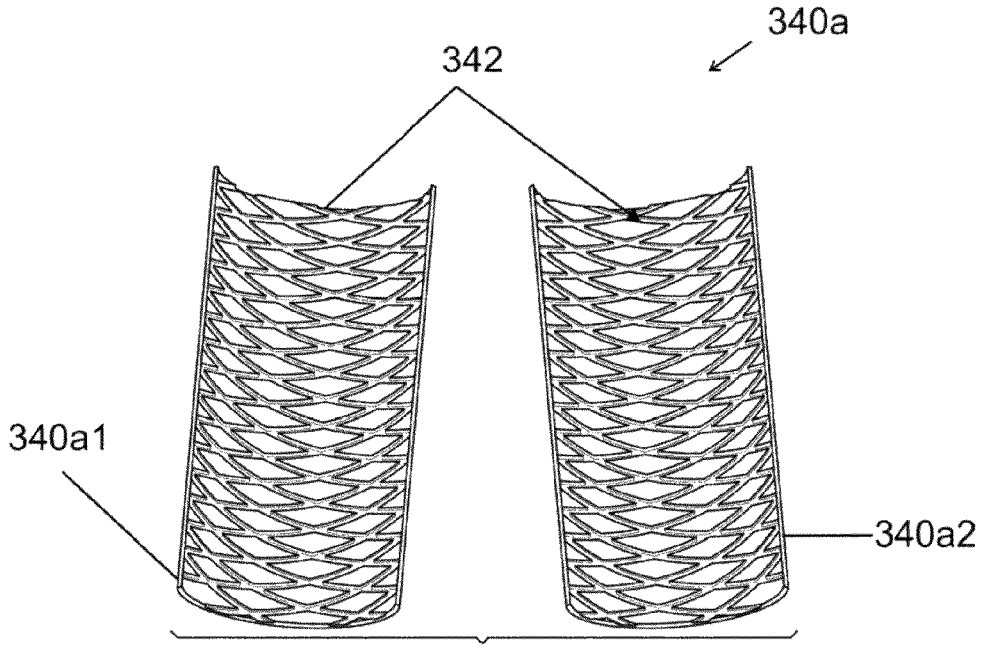
FIG. 3

SWAGED-ON, EXTERNAL ELECTRODE ANCHORING CONNECTION

STATEMENT OF GOVERNMENT INTEREST

The invention described herein may be manufactured and used by or for the Government of the United States of America for Governmental purposes without the payment of any royalties.

BACKGROUND OF THE INVENTION

1. Field of the Invention

The present invention relates generally to a swaged-on fitting, and in particular to an anchoring swaged-on fitting for mounting a coaxial layer of conductive wires on a cable jacket, where the swaged-on fitting has an inside recessed grooved pattern that secures the swaged-on fitting on the cable without piercing the cable jacket.

2. Prior Art

While there are many types of connecting fittings for coaxial cables, most of these fittings function to connect similar sizes of coaxial cables, split the cable prior to connecting, or are designed to change the size of a pair of connecting cables. There is a dearth of art that reads on adding an outer layer to a contiguous coaxial cable. Adding the outer layer typically requires a termination fitting, where a first coaxial cable is terminated, and then attached to a second coaxial cable with the outer layer.

Applicant is unaware of any art that reads on a swaged-on fitting that doesn't destructively distort the cable jacket when an outer ring of the fitting is crimped or swaged such that the fitting bites into the cable jacket. Jacket distortion becomes even more necessary when the jacket is made of an inherently low friction material such as polytetrafluoroethylene. For example the static friction of steel on Teflon™ (a DuPont product) is 0.04, while the static friction of steel on steel is 0.80, a factor of 20, according to the Engineering Toolbox web site (see *Frictional Coefficients for some Common Materials and Materials Combinations,* http://www.engineeringtoolbox.com-/friction-coefficients-d_778.html).

SUMMARY OF THE INVENTION

The invented anchoring swaged-on fitting in one variation is a fitting for appending various elements such as sensors and wires to a cable without damaging the cable, and in particular the cable's jacket, where damage is evidenced by piercing. Exemplary of an appended element is an outer conductive layer to a contiguous coaxial cable, without cutting or significantly distorting the cable, which at a minimum, will make the cable much less resistant to corrosion.

An example of a contiguous coaxial cable is a magnetic influence minesweeping cable. The cable is used to create a magnetic field that simulates the magnetic signature of a ship. The cable has a pair of electrodes in contact with salt water. Salt water is conductive, and thusly can act as a leg in an electrical circuit when conducting a magnetic sweep. Salt water is also corrosive, and it is especially corrosive to electrodes, where the electrode is in contact with an electrical current, salt water, sun, and air. With open loop sweeps, the electrodes are in contact with at least three: salt water, current, and air.

Typically, the electrodes are the components of the magnetic influence minesweeper coaxial cable that corrode the fastest, and an object of the invention is to append an end of an electrode to an S-cable. The S-cable is a coaxial cable that usually extends substantially the entire length of the magnetic influence minesweeper coaxial cable. The S-cable is typically about 575 feet long, so the tension on the cable is high during minesweeping operations. The S-cable has a core axial strength member, which is typically wrapped with a separator, then an inner conductor; and, on the outside of the S-cable, there is an insulating jacket. The jacket is typically composed of polytetrafluoroethylene (PTFE), which has excellent corrosion resistance and a very low coefficient of friction. There are few materials that will adhere to it.

The anchoring swaged-on fitting includes at least two swaged-on elements. The first element is an outer ring that is an open-ended cylinder, where the outer ring has a top edge, a bottom edge, a first length and a first curvature. Curvature is defined as the inverse of the radius, and it is smaller for a larger circle than a smaller circle. Curvature is similar to diameter, but doesn't require a complete circle to calculate. The second element is an inner ring that substantially is an open-ended smaller cylinder, with a second length and a second curvature. Because the inner ring is smaller it has greater curvature. The inner ring has an inside grooved pattern, and when swaged-on the inside grooved pattern comes into direct contact with the cable jacket. The inside grooved pattern enables the swaged-on fitting to grip the jacket with sufficient resistance to prevent translational movement and rotational movement of the outer conductive layer appended to the coaxial cable via the fitting.

As previously recited, the outer conductive layer is a layer of a plurality of wires that are coaxially layered on the S-cable. The exposed bare wires are the electrode. Evidence of slippage of the fitting on the cable is manifest if the electrode starts twisting (rotational) or bird caging (translational or rotational as each layer of wires is helically wound). As will become clear, anchoring is not only a function of how tightly the jacket is gripped, but the way it is gripped. Anchoring is achieved by moving from a gripping mechanism that is a substantially frictional grip to a substantially interference fit.

Another aspect of the invention is that the inner ring has several configurations that make it easier to install. Most notably it has been found that the inner ring can be assembled on the cable, as an inner ring that has been longitudinally split. Exemplary of one variation is a split inner ring that is a pair of inside grooved inner halves, where each inside grooved inner half is one half of an open-ended longitudinally split cylinder. Each inside grooved inner half has an inside grooved pattern. Each inside grooved inner half has a second length and each inside grooved inner half has a second curvature. The advantage of the split inner ring is that in assembling, the split inner ring does not have to be slid over potentially thicker portions of the cable, and each inside grooved inner half can have a larger curvature, such that the assembly of halves has a diameter very similar to the diameter of the cable. The possibility exists to split the inner ring into smaller fractions, such as thirds and quarters, but the cost and installation of smaller fractions usually do not justify using smaller fractions.

Another aspect of the invention is that the mechanical grip to the jacket does not pierce the jacket. If the jacket is pierced the inner conductor will be exposed directly to salt water, substantially resulting in the destruction of the cable, which is carrying an electrical current, due to corrosion.

BRIEF DESCRIPTION OF THE DRAWINGS

The foregoing invention will become readily apparent by referring to the following detailed description and the appended drawings in which:

FIG. 1 is an elevated end-on perspective view of an outer ring of an anchoring swaged-on fitting;

FIG. 2 is an elevated end-on perspective view of an inner ring of an anchoring swaged-on fitting;

FIG. 3 is an elevated perspective inside view of the split inner ring shown in FIG. 2*a*, illustrating the two inside grooved inner halves;

DETAILED DESCRIPTION OF THE INVENTION

Figure 2A:
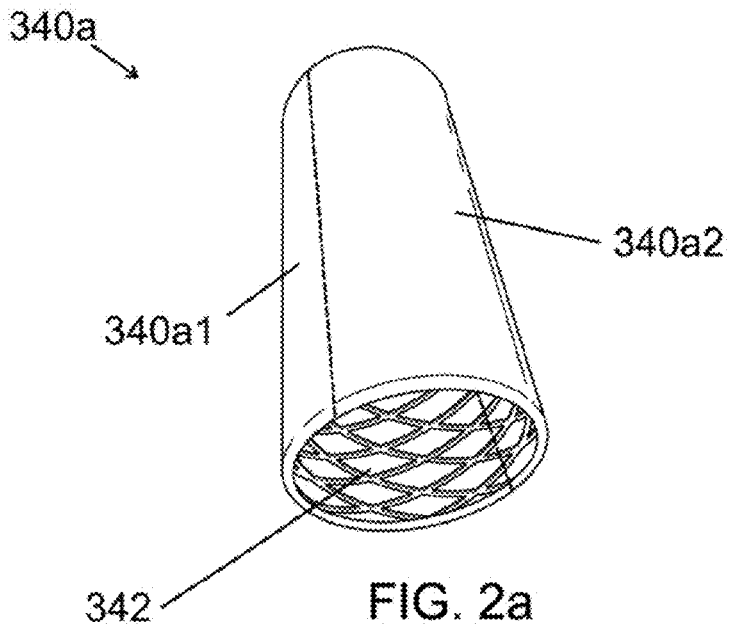
FIG. 2*a* is an elevated end-on perspective view of a split inner ring of an anchoring swaged-on fitting, where the split inner ring is split into a pair of inside grooved inner halves.

A novel an anchoring swaged-on fitting is herein disclosed. The anchoring swaged-on fitting enables wires, particularly a layer of wires, to be appended to a jacket covering a rope or a cable. In the illustrated embodiments the layer of wires are bare, having no insulation, and are functioning as an electrode on a minesweeping cable.

The anchoring swaged-on fitting 300 includes an outer ring 310 as shown in FIG. 1, which is a metallic open-ended cylinder having a first length 316, a first inside diameter 314, and a first curvature 318. The fitting 300 also includes an inner ring 340 as shown in FIG. 2. The inner ring 340 is a metallic open-ended smaller cylinder with an inside pattern 342. The inner ring 340 has a second length 346, a second inside diameter 344, and a second curvature 343.

In another variation, as illustrated in FIG. 2*a* the inner ring 340*a* can be slit longitudinally, forming a pair of inside-grooved inner halves 340*a*1,340*a*2. Each inside-grooved inner half is one half of an open-ended longitudinally split cylinder. The inside grooved pattern 342 is the same pattern as shown illustrated in FIG 3, described in more detail below. The second length 346 and the second curvature 348, as shown in FIG. 2, remain unchanged by the splitting, and when the halves are assembled into the cylinder 340 the second diameter 344 is slightly reduced by the kerf of the cut. The cut of the blade, or one kerf, can be minimized by using a thin wire Electronic Discharge Machine (EDM). The EDM reduces each kerf to about 15 mils, so a one inch (1.000) inside diameter cylinder is reduced to about 0.997 inches in diameter.

Figure 2B:
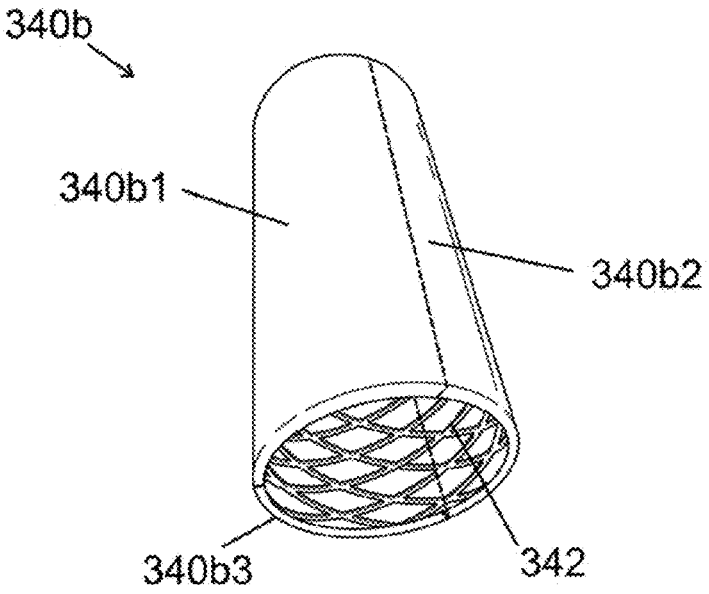
FIG. 2*b* is an elevated end-on perspective view of a split inner ring of an anchoring swaged-on fitting, where the split inner ring is split into a set of thirds.

In another variation, as illustrated in FIG. 2*b* the inner ring 340*b* may be slit longitudinally into thirds forming a set of three inside grooved inner thirds 340*b*1,340*b*2,340*b*3. Each inside grooved inner third is one third of the open-ended longitudinally split cylinder 340*b*. Again, the assembled dimensions are only slightly smaller.

The inside grooved pattern 342 of all variations discussed above is shown in FIGS. 3 and 9. The pattern is substantially a recessed, grooved, cross-hatching, where the hatching is circumferentially oblong. All the grooves are helical, about half are right handed helixes 370R and the other half are left handed helixes 370L. Any given groove is parallel to half of the other grooves, but not orthogonal to the other half, so that the un-etched spaces between the grooves are approximately diamond shaped (see 342*d* in FIG. 8). Looking down on a cylinder half, one can see that a lead angle 371, which is the geometric complement of a helix angle 373, is more open than the helix angle 373 (about 55 degrees versus about 35 degrees in the illustrated embodiment), and hence the hatching is circumferentially oblong. An exemplary pattern is shown in detail in FIG. 9. The right handed helical grooves 370R and the left handed helical grooves 370L define the geometry of un-etched space. The included lead angle 377 of the un-etched space is composed of the sum of two lead angles (55+54=109 degrees). The included helix angle 375 of the un-etched space is composed of the sum of two helix angles (35+36=71 degrees). The total of all included angles is about 360 degrees assuming that the un-etched space is planar. If the un-etched space is not planar, then allowances must be made for the curvature.

If the helix angle is about 45 degrees, then the un-etched spaces between the grooves are approximately square shaped, and are not circumferentially oblong. If the helix angle 373 exceeds 45 degrees then the un-etched spaces are longitudinally oblong. The right helix angle 370R and the left helix angle 370L need not necessarily be identical, but if they are not the resulting diamond will be skewed toward the larger helix angle. Note that the specific angles discussed above and illustrated in FIG. 9 are representative of only one embodiment of the invention, and should be construed as limiting the scope of the invention as claimed. This pattern is selected to seal the anchoring swaged-on fitting onto the jacket of the cable and thus provide translational and rotational resistance to movement about the cable.

In the preferred embodiment, none of the grooves run either purely circumferentially or longitudinally. This is by design, because a purely longitudinal groove could potentially allow water to seep through the longitudinal groove, especially when the cable is submerged and therefore under high external water pressure. The invented pattern, wherein the helix angle of the diamond is more closed, provides that there is a lower density of diamonds circumferentially than longitudinally; or, stated alternatively, the circumferential components of the grooves are closer together than the longitudinal components of the grooves, and the net effect is that there is better occlusion of water and higher resistance to translational movement. Resistance to rotational movement is enhanced by the diamond-like hatching. Also, the invented pattern recognizes that the length of the fitting can be extended, albeit making the cable stiffer and potentially more difficult to wind. However, however the diameters of the fitting components are essentially fixed by the diameter of the cable. The pattern provides an appropriately balanced resistance against rotational and translational forces. Furthermore, the angled cross-hatching follows the contour of the inner ring, so that the resulting relatively large un-etched diamond shaped spaces are also curved.

Figure 8:
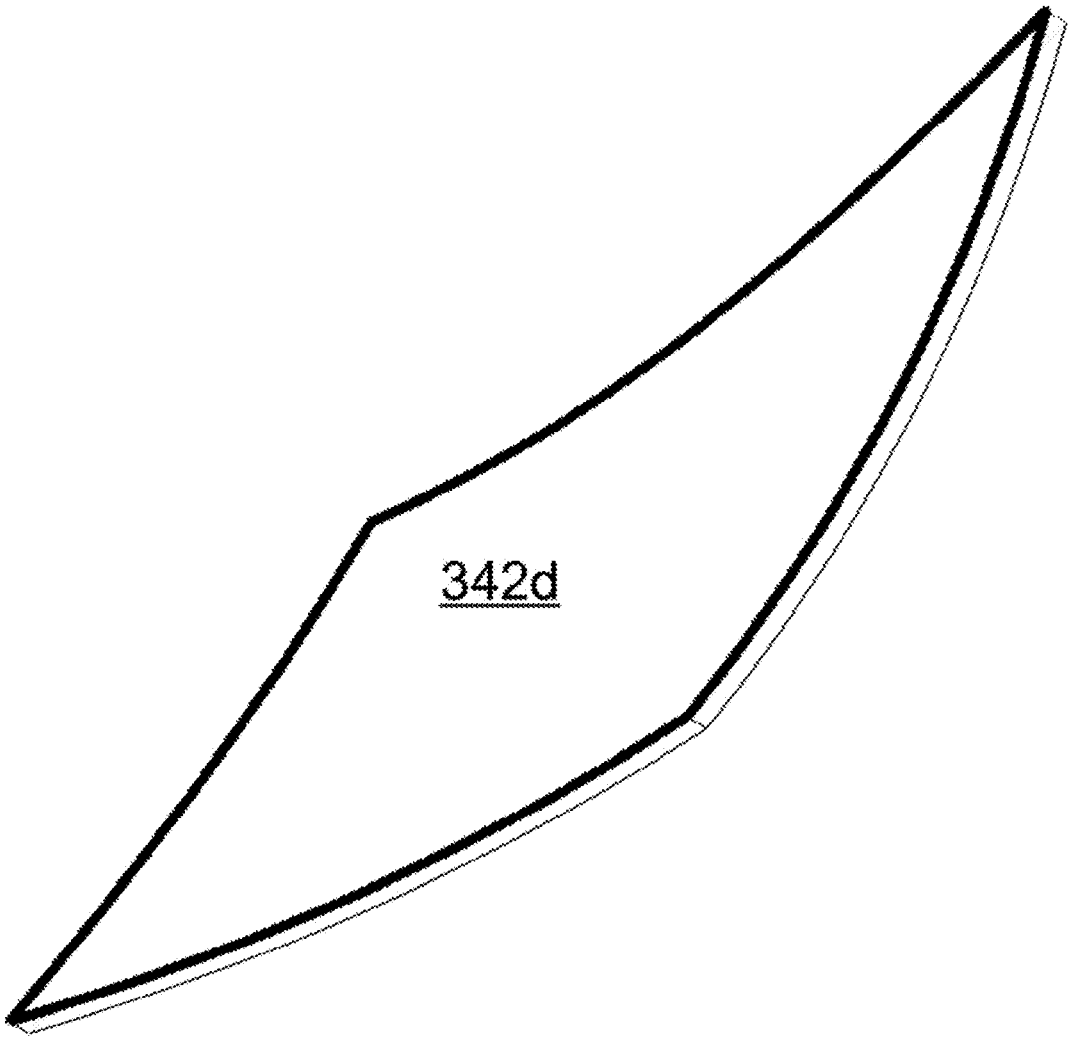
FIG. 8 is a greatly expanded diagrammatic view of a cross-hatching pattern, illustrating that the cross-hatching pattern is angled and the resulting un-etched surface between the grooves is substantially a shape that approximates an oblong diamond, where the edges of the diamond are curved, wherein the curvature is a result of the cross-hatching pattern being angled and on the inside of cylinder, which has a curved surface.
Figure 9:
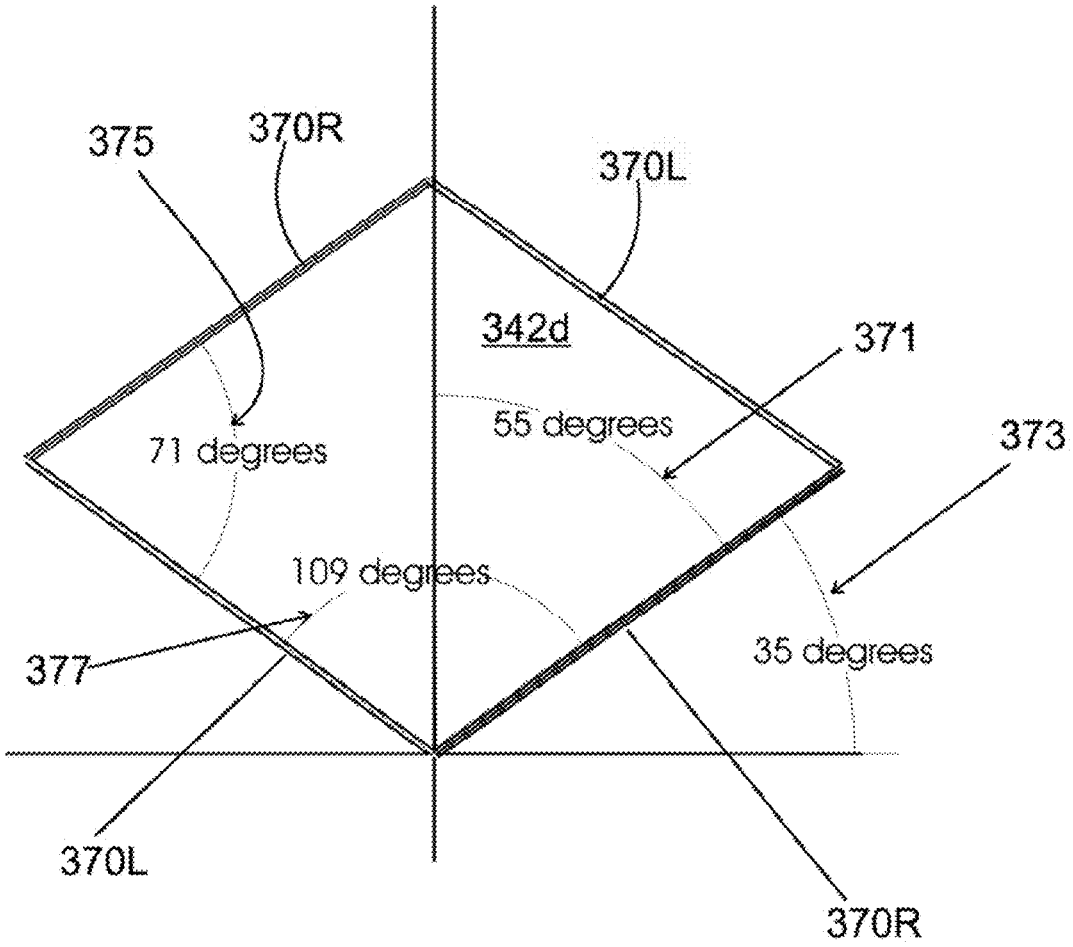
FIG. 9 is a diagrammatic depiction of how the angles of the plurality of left handed and the right handed helical grooves determines the geometry of the cross-hatching pattern.

FIG. 8 illustrates one of the oblong curved diamonds 342*d* created by the shallow angled grooves. The angled cross-hatching resists both translational and rotational movement. When the anchoring fitting is swaged onto the cable, the diamonds are embossed into the cable jacket without piercing completely through the jacket. The primary griping mechanism changes from being frictional to interlocking, where there is an interference fit caused by the protrusion of the jacket's embossing pattern into the inner ring's shallow grooves. Only enough force necessary to emboss the jacket is needed to change the gripping mechanism. Important aspects include the depth of the grooves, their width and the space between grooves, and the characteristics of the jacket, where the characteristics include the thickness of the jacket. For example, the depths of the grooves, and so the heights of the resulting diamonds, are preferably not larger than the thickness of the cable jacket so as to avoid unintentional piercing of the jacket.

Figure 6:
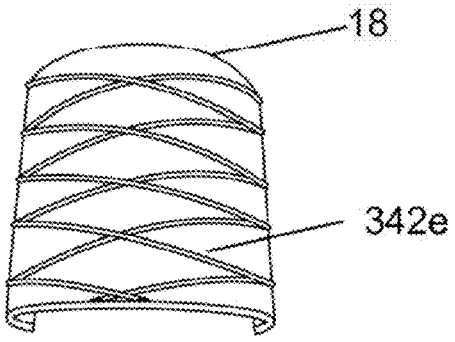
FIG. 6 is an overhead view of a section of the PTFE cable jacket illustrating the embossing imparted by the inside grooved patter during swaging.

FIG. 6 shows a section of the jacket 18 that is embossed by the anchoring swaged-on fitting. The swaging produces an embossed pattern 342*e* in the jacket. The grooved cross-hatching pattern has changed the primary gripping mechanism from being one that is predominately frictional to one that is predominately an interference fit.

Figure 4:
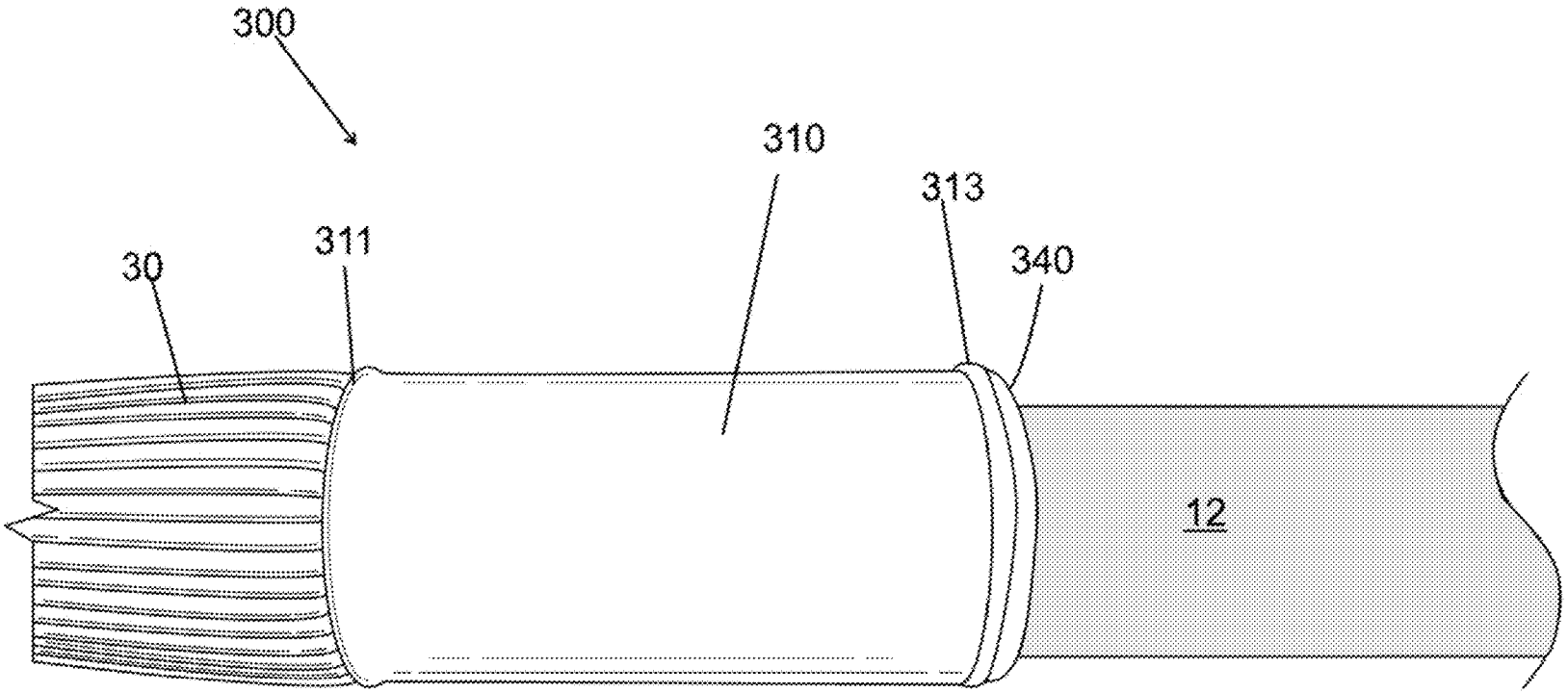
FIG. 4 is a side view of the anchoring swaged-on fitting after being swaged, appending the layer of wires to the cable, wherein the layer of wires is anchored between the outer ring and the inner ring and the fitting is anchored to the cable's jacket, where the cable's jacket is composed of PTFE.

Referring now to FIG. 4, the outer ring 310 has edges 311,313 that are flared. Following the swaging process, the edge 311 opposite the terminated end of the wires 30 will be slightly flared to provide wire stress relief. During the swaging process the diameter of the outer ring is reduced. The swaging process also deforms the soft inner conductor of the S-cable 12, but maintains the overall roundness of the cable. The inner ring 340 is somewhat crimped, like the lip of a metal can, to the outer ring 310.

Figure 5:
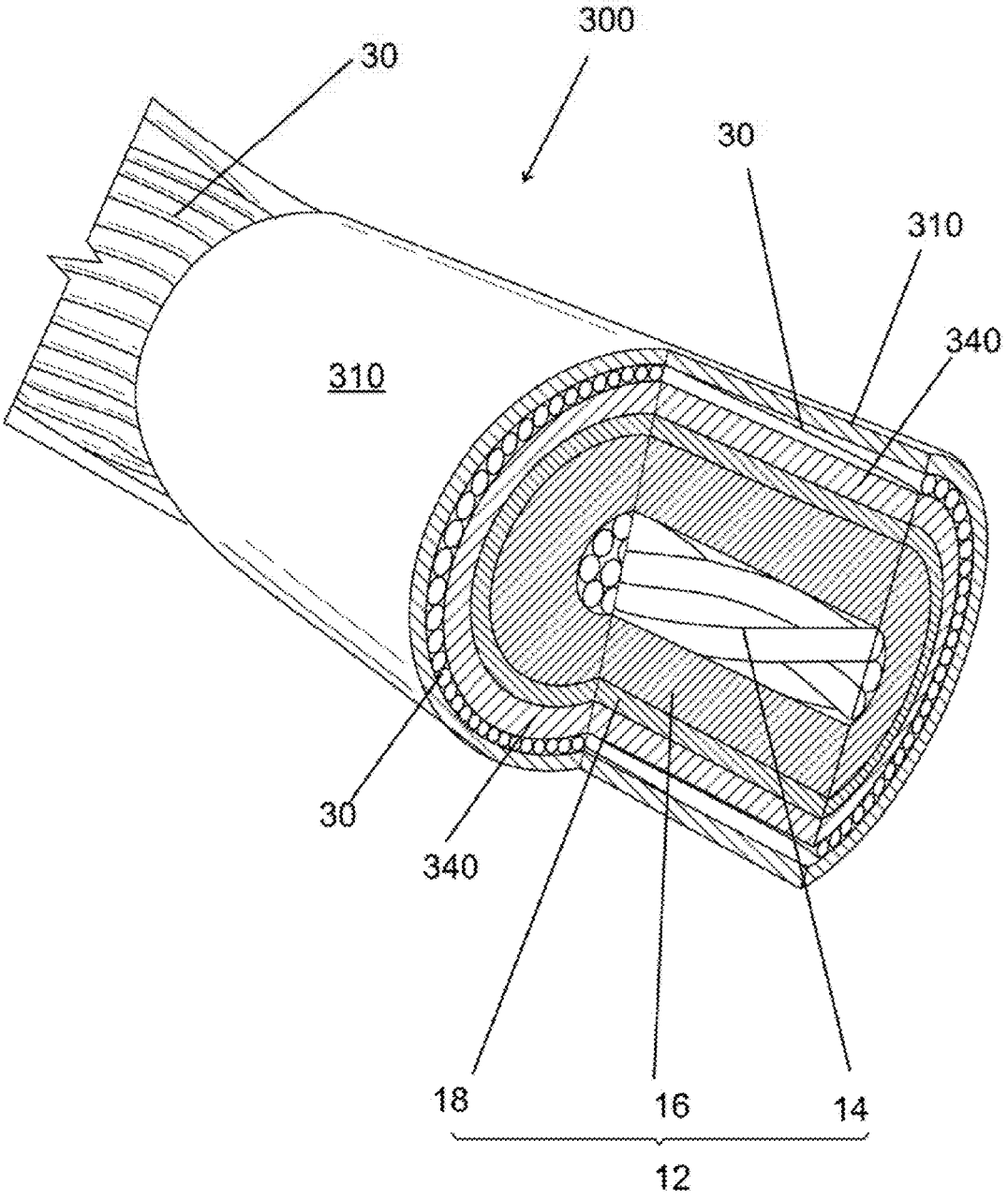
FIG. 5 is a cross-sectional view of the anchoring swaged-on fitting after being swaged-on, illustrating that the S-cable, and, in particular the jacket and the inner conductor, are substantially not deleteriously impacted by the swaging.

All of the elements of FIG. 4 are illustrated in the cutaway view of FIG. 5. The fitting 300 anchors electrode 30 to the S-cable 12. The typical S-cable 12 comprises a strength member 14, an inner conductor 16 that is nominally a soft aluminum, and a PTFE jacket 18. As illustrated, inner ring 340 covers a portion of the jacket 18 of cable 12 in the vicinity of the ends of the wires 30 that are to be anchored to the cable. And the ends of wires 30 are disposed between the outer ring 310 and inner ring 340.

Figure 7:
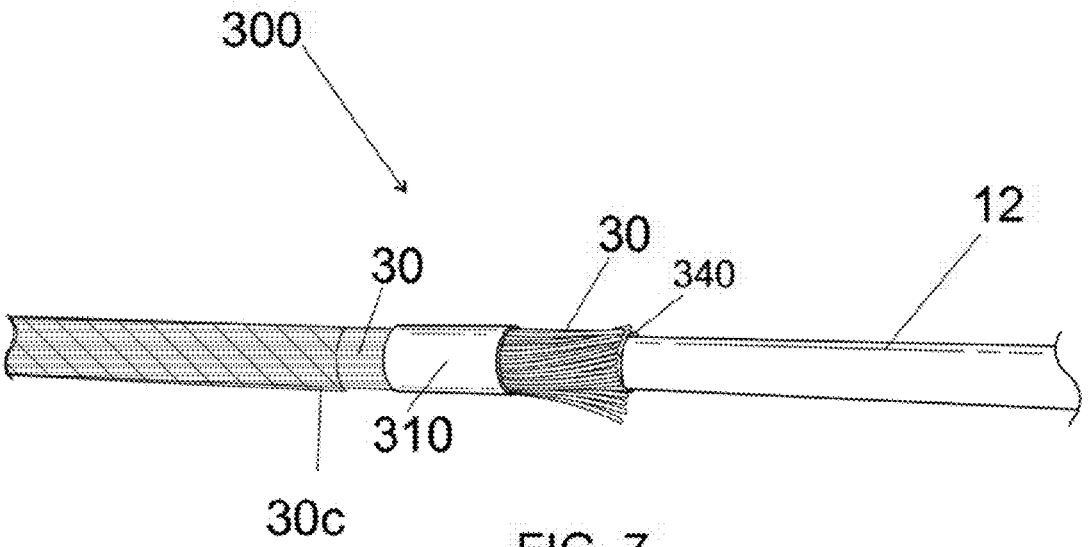
FIG. 7 is a side view of the cable having an outer conductor that is being fitted with the anchoring swaged-on fitting, wherein most of the outer conductor is wrapped with a protective sheath of a film, except for an end of the layer of exposed wires (which are loose), where the outer ring has been slid over and past most of the film, but still remains pulled back from the end in a position ready to be slid over the exposed wires, while a pair of inside grooved inner halves are positioned on the cable under the end of the layer of exposed wires.

FIG. 7 shows an intermediate step for attaching a layer of wires that make-up the electrode 30 to the S-cable 12 utilizing the anchoring swaged-on fitting 300. The layer of wires is typically partially protected, wrapped with a protective sheath of a film 30*c*, which is typically a polyester film. The outer ring 310 has been slipped down the cable until it almost covers the bare ends of the electrode wires 30. Barely visible in FIG. 7 is the inner ring, 340 which has been slid under the end of the layer of exposed wires 30. As can be seen, the exposed wires 30 are bare and loose. Once the inner ring 340 is positioned under the wires 30, the outer ring 310 can be slid over the wires. The movement of sliding the outer ring 310 over the wires 30 helps to align the wires in a layer, as shown in closer detail in FIG. 5. Additionally, prior to swaging, the wires and the outer ring are rotated to ensure that the wires are tightly wound in a helical configuration around the cable jacket. Swaging presses the inside grooved pattern of the inner ring 340 against the cable, therein embossing the jacket, while at the same time crushing the electrode wires 30 between the inner ring 340 and the outer ring 310. In this way, inner ring becomes fixed to cable 12 in a way that resists rotational and translational movement, and wire 30 become fixed between inner ring 340 and outer ring 310, effectively fixing wire 30 to cable 12 without penetrating jacket 13. Any wire ends projecting from the fitting can be trimmed off after swaging. The fitting 300 in this preferred embodiment is made of stainless steel to limit corrosion of the fitting.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A cable having external wires affixed thereto, comprising:

an inner cable having a jacket that shields said inner cable from the ambient environment, said jacket having an embossable outer surface;

a plurality of conductive wires disposed on said outer surface of said jacket;

a hollow, cylindrical inner ring disposed between said outer surface of said jacket and said conductive wires and encompassing said inner cable, said inner ring having an inner surface having a cross-hatched grooved pattern in contact with and embossing said outer surface of said jacket without piercing said jacket;

a hollow, cylindrical outer ring encompassing said wires, said inner ring, and said inner cable;

wherein said outer ring and said inner ring are swaged to compress and hold said wires and said inner cable in a fixed relative position.

2. The cable of claim 1, wherein said inner ring is longitudinally split into a plurality of sections that can be re-assembled when said inner ring is placed to encompass said inner cable.

3. The cable of claim 1, wherein said jacket has a thickness and the depth of the grooves in said grooved pattern are less than said thickness.

4. The cable of claim 1, wherein said inner and outer rings are made of stainless steel.

5. The cable of claim 1, wherein said jacket is waterproof and electrically insulating.

6. The cable of claim 5, wherein the jacket is composed of a resilient polymeric material.

7. The cable of claim 5, wherein the jacket is made of polytetrafluoroethylene (PTFE).

8. The cable of claim 5, wherein said inner cable is an S-cable of a magnetic influence minesweeping cable, said S-cable comprising a core strength member, an aluminum inner conductor encompassing said strength member, and said jacket, wherein said jacket is made of polytetrafluoroethylene (PTFE).

9. The cable of claim 8, wherein said plurality of conductive wires are wound helically about said jacket.

10. The cable of claim 8, wherein said plurality of conductive wires comprise an external electrode of said minesweeping cable.

11. The cable of claim 1, wherein said cross-hatched grooved pattern comprises helical grooves in said inner surface of said inner ring, and wherein said pattern is circumferentially oblong.

12. A method for anchoring external wires to a cable having an embossable jacket while maintaining the integrity of the jacket, comprising the steps of:

winding the external wires about the exterior of said jacket;

placing a hollow, cylindrical inner ring around said jacket and under the external wires adjacent to an end of the external wires, said inner ring having an inner surface having a cross-hatched grooved pattern, wherein said step of placing includes placing said cross-hatched grooved pattern in contact with said jacket;

sliding a hollow, cylindrical outer ring over the external wires and said inner ring;

swaging together said outer ring, said inner ring, and the external wires so that the external wires are anchored between said outer and inner rings, and said cross-hatched grooved pattern in said inner ring embosses into and grips the jacket without piercing through the jacket.

13. The method of claim 12, wherein said step of winding comprises tightly winding the external wires helically about the jacket.

14. The method of claim 12, further comprising the step of trimming the ends of the external wires that extend from the inner and outer rings.

15. The method of claim 12, wherein said cylindrical ring is longitudinally split into a plurality of sections, and wherein said step of placing further comprises placing each of said plurality of sections around the jacket to form a cylinder encompassing the jacket.

* * * * *